United States Patent [19]

Birch

[11] Patent Number: 4,767,649

[45] Date of Patent: Aug. 30, 1988

[54] BROAD SPECTRUM CAMOUFLAGE MAT AND SCREEN

[76] Inventor: Jorgen Birch, 923 7th St., Apt. E, Santa Monica, Calif. 90403

[21] Appl. No.: 928,991

[22] Filed: Nov. 10, 1986

Related U.S. Application Data

[63] Continuation-in-part of Ser. No. 796,847, Nov. 12, 1985, Pat. No. 4,659,602.

[51] Int. Cl.[4] ..... F41H 3/00

[52] U.S. Cl. ..... 428/99; 428/132; 428/136; 428/137; 428/212; 428/247; 428/919

[58] Field of Search ..... 428/99, 132, 136, 137, 428/212, 247, 919

[56] References Cited

U.S. PATENT DOCUMENTS

| | | | |
|---|---|---|---|
| 3,069,796 | 12/1962 | Rüter | 428/919 |
| 3,733,606 | 5/1973 | Johansson | 428/919 |
| 4,493,863 | 1/1985 | Karlsson | 428/17 |
| 4,560,595 | 12/1985 | Johansson | 428/7 |
| 4,659,602 | 4/1987 | Birch | 428/88 |
| 4,671,988 | 6/1987 | Dowell | 428/919 |

*Primary Examiner*—Marion C. McCamish
*Attorney, Agent, or Firm*—Christie, Parker & Hale

[57] ABSTRACT

A multispectral three-dimensional camouflage mat has a base or substrate layer into which are woven strands of yarn of varying length and color to simulate terrain or landscape, or alternatively to serve as a decoy by simulating a target. Desired reflection and absorption of visible light as well as infrared, ultraviolet, and microwave frequencies is provided by materials integrally contained within the yarn strands, and by supplemental materials on the base layer. An alternative embodiment is a light-penetrable camouflage screen which also uses the concept of integral incorporation of reflecting and absorbing additives for nonvisual wavelengths in plastic material forming the body of the screen.

12 Claims, 2 Drawing Sheets

Fig. 1
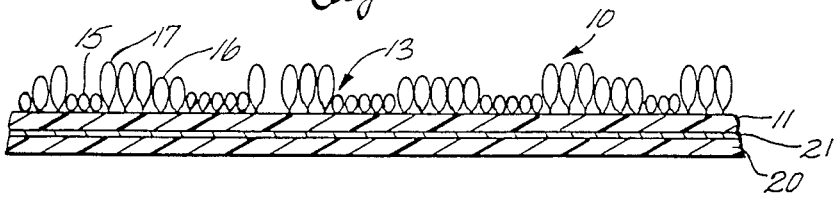
Fig. 2A
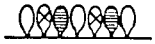
Fig. 3A
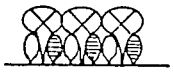
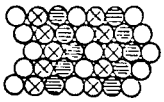
Fig. 2B
Fig. 4A
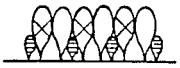
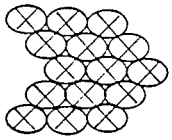
Fig. 3B
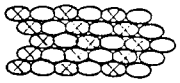
Fig. 4B
Fig. 5A
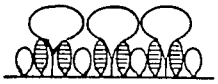
Fig. 6A
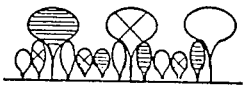
Fig. 5B
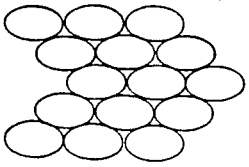
Fig. 6B
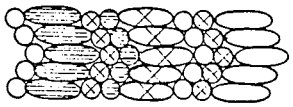

BROAD SPECTRUM CAMOUFLAGE MAT AND SCREEN

CROSS REFERENCE TO RELATED APPLICATION

This application is a continuation-in-part of U.S. patent application Ser. No. 796,847 filed Nov. 12, 1985 now U.S. Pat. No. 4,659,602.

BACKGROUND OF THE INVENTION

The art of military camouflage has as alternative objectives the concealment of a potential target (building, road or pathway, aircraft, weapon emplacement, tank, etc.), or the simulation of a false target or decoy which attracts attention away from true targets. In earlier times, camouflage mats or nets covered the target, and were designed only to avoid visual target detection by presenting an appearance unlike a target and similar to the surrounding terrain. Such simple visual camouflage thus consisted of a covering surface which was painted or otherwise configured to appear as an ordinary ground or terrain surface, while concealing the target beneath.

Visual camouflage remains of great importance, but the requirement for concealment is enlarged and complicated by the development of other types of military sensing and viewing devices. Older forms of camouflage may thus be useless as a countermeasure to radar surveillance, as well as to interrogation systems using electromagnetic wavelengths in the ultraviolet and infrared regions. An unprotected and operating military tank or other vehicle, for example, is easily seen by infrared sensors which detect heat (infrared) radiation emitted by the machine's hot engine and exhaust system.

Modern camouflage is accordingly designed to provide multispectral (ultraviolet, visual, infrared, and radar wavelengths) protection, and typical examples of such camouflage matting are disclosed in U.S. Pat. No. 4,287,243 and 4,528,229. Broadly, the present invention is directed to improvements to the general style of mat described in these patents; and to camouflage net-like screens. These camouflage systems create a three-dimensional effect, and are an effective countermeasure to both active and passive surveillance equipment operating in a broad range of frequencies or wavelengths ranging from ultraviolet through visible and infrared into themicrowave area.

When target concealment is the objective, knowledge of the terrain characteristics (e.g., farmland, woodland, snow, swamp, desert, etc.) is essential if the risk of target detection is to be minimized. The camouflage should minimize or eliminate contrast of the target against the background terrain, suppress transmission of energy (e.g., far infrared) emanating from the target, and reflect, scatter, or absorb incoming target-illuminating energy beams (e.g., radar, sunlight, laser coherent radiation, etc.) in a fashion simulating the return or signature of the surrounding terrain. The main thrust of the present invention is to give the camouflage designer greater flexibility in creating customized target-concealing devices effective against both near and distant observers or sensors, and also to enable the accurate simulation of a target if the objective is to create a decoy or false target.

SUMMARY OF THE INVENTION

This invention relates to camouflage and target-simulating mats having a base-layer substrate supporting a dense carpet-like pile of yarn strands which are preferably individually formed by air-entangled spun-together continuous filaments or fibers of plastic material. Visual effects are created by using yarn strands of various preplanned, nonrandom lengths and colors to provide the desired overall pattern, color, and texture; with reflection, scattering, and absorption properties being under the designer's control. These characteristics are physically and chemically integrated into the yarn-strand fibers during fiber extrusion.

Different types of fibers (e.g., solid plastic and metallic-coated plastic) may be spun into a single yarn strand to enhance the desired control over incoming electromagnetic energy beams from an interrogating surveillance source. Further control of this energy, as well as reflection and suppression of energy radiated from the target to be concealed, is provided by additional substrate laminae or fibrous materials on the backing layer.

An important feature of the invention is the ability to provide highly accurate visual simulation of the natural environment. Control over color, size, and reflectance of individual yarn strands at multiple levels enables simulation of small details such as foliage, stems, flowers, grass and other vegetation, with a three-dimensional effect defying detection by either near or distant viewers. These details are integrated in either one or multiple patterns in the mat, with consideration being given to the shape of the object being concealed (which may dictate the orientation and draping of the mat), and the expected position (azimuth and altitude) of the observer.

A second embodiment of the invention relates to a light-penetrable meshlike sheet of camouflage garnish material which is formed (preferably by extrusion) of a plastic material which integrally incorporates additives physically or chemically integrated into the material prior to formation as a sheet, the additives providing selected camouflage properties with respect to nonvisual wavelengths in the infrared, ultraviolet or radar segments of the electromagnetic spectrum. Preferably, the sheet is a cross-laminated multi-ply construction which provides good strength characteristics, and enables heavier and more diverse loading of camouflage additives in the plastic polymer or prepolymer while it is in a liquid state prior to sheet formation.

DESCRIPTION OF THE DRAWINGS

FIG. 1 is a sectional side view of a camouflage mat according to the invention;

FIGS. 2A and 2B are schematic side and top views respectively of a tuft pattern with a single tuft height;

FIGS. 3A and 3B are schematic side and top views respectively of a pattern using tufts of two heights;

FIGS. 4A and 4B are schematic side and top views respectively of another style of pattern using tufts of two heights;

FIGS. 5A and 5B are schematic side and top views respectively of a pattern using tufts of three heights;

FIGS. 6A and 6B are schematic side and top views of another style of pattern using tufts of three heights.

DESCRIPTION OF THE PREFERRED EMBODIMENT

Figure 7:
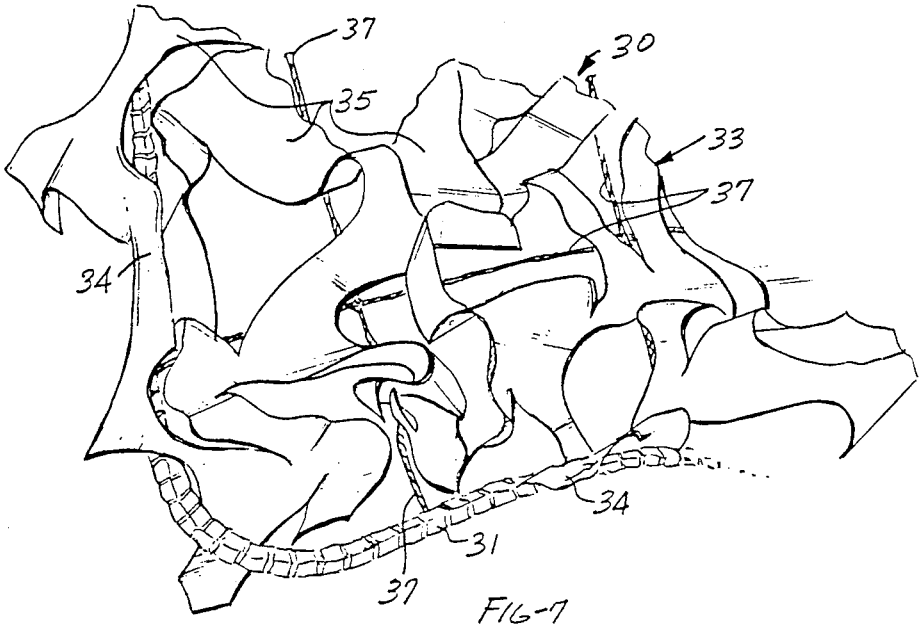
FIG. 7 is a pictorial view of another embodiment of the invention in the form of a camouflage screen.

A presently preferred camouflage mat 10 according to the invention is shown in FIG. 1 of the drawings. The mat has a base lamina or backing layer 11 which is preferably a sheet of polypropylene plastic in either solid or mesh form. The thickness of this layer is not critical, but is preferably about one or two millimeters to be compatible with tufting machinery which is useful in manufacture of the mat.

The upper surface of mat 10 is a dense pile or body 13 of tufted yarn strands 15, 16 and 17 which are secured to and extend from backing layer 11. Preferably, the strands are formed as loop pile rather than cut pile to provide a self-supporting springy quality to the mat upper surface. Each strand has at least a single base fiber or filament which is preferably a plastic material such as bulk-continuous-filament (BCF) polypropylene or nylon. The plastic material incorporates additives, and other fibers may be interwoven with the base fiber to impart desired reflecting or absorbing properties as discussed below. Either a shrinking or nonshrinking material may be selected, but a shrinkage characteristic is generally desirable in that it results in curled tufts with a springy bounce-back quality.

The individual extruded yarn fibers or filaments can vary in diameter from about eight microns up to several millimeters (depending primarily on the characteristics desired with respect to incoming radar signals), and these fibers can in turn be spun into yarn strands of any desired yarn number or weight. A similar flexibility is available with respect to tuft density which may range from about 5,000 (for a bulky yarn) to over 200,000 loops per square yard.

Attachment of the strands to the backing layer is economically done by any of several methods which are used in the carpet-making industry. For example, the attachment techniques of tufting, weaving, needle punching, or fusion bonding are applicable to this fabrication step. Cement is applied to the undersurface of the backing layer to secure the strands (which could otherwise separate after attachment), to seal this layer so it is impervious to liquids such as rainwater, and sometimes to adhere one or more auxiliary layers or laminae (discussed below) to the base layer.

The individual strand fibers are preferably formed by extrusion, of a liquid polymer or prepolymer material in which various additives are included to provide desired environmental and camouflage properties. The phrase "camouflage properties" is used herein to designate properties which selectively and predictably alter the transmission, absorption, reflection, and scattering of incident electromagnetic energy. The additives are selected from (and may include all of) the following materials:

a. An absorber of ultraviolet radiation to prevent texture and color deterioration of the strands by sunlight, and also to diminish the effectiveness of a surveillance detection system using wavelengths in the ultraviolet region. A suitable additive for this purpose is available under the trademark "Thimassorb 944" from Ciba Geigy, and alternative materials are commercially available.

A bacteriostatic material to resist degradation of the fiber by bacterial attack. Various materials of this type are available, and a "Microcheck" product available from Ferro Chemical is suitable.

c. A fire-retardant material such as aluminum trihydrate to provide improved fire resistance and an increased melting point.

d. A delustrant such as titanium dioxide to diminish or dull the natural luster of the plastic material, thereby providing further control over the reflectance (shine) and color lightness of the strand to improve simulation of these properties in a false visual display of a natural environment by the camouflage mat.

e. A dye of other coloring agent to impart the desired color (typically black, brown or tan, and various shades of green, as discussed below) to the strand, and to provide controlled absorption or reflection of infrared radiation.

f. A radar-absorbing material such as finely powdered carbon or graphite, a radar-reflecting metallic material such as silver, copper, and the like (including compounds of such metals), or mixtures of absorbers and reflectors.

g. An antistatic material (the types commonly used in the carpet industry are satisfactory) to avoid an undesirable buildup of static electricity.

The properties provided by these additives are thus integrated into the strand fibers to provide improved life and wear resistance, more accurate and realistic simulation, and economy through use of automated production equipment.

Preferably, the individual yarn strands are made of multiple fibers which are blown together in an air-entangling process as used in the manufacturing of yarn for conventional carpets. Multiple fibers give the individual yarn strands strength, durability, and a self-supporting quality, but importantly also enable the camouflage designer to enhance further the specific reflection, scattering, and absorption properties desired in an overall camouflage pattern. Subtle multicoloration of individual strands is also made possible by the air-entangling technique.

In some cases requiring heavy doses of additives integrated into the extruded fiber as discussed above, it may not be practical to incorporate all needed additives in a single fiber while maintaining fiber strength and avoiding additive interaction. In such cases, the additives are simply allocated among different fibers which are then air entangled and spun together into a strand which provides all of the desired properties.

In other cases, particularly with metallic additives, it may not be practical to integrate the additive into the strand material prior to extrusion. The solution is to spin by air entanglement a metal or metal-coated fiber into the yarn strand to provide, for example, desired broadband radar reflection, scattering, or absorption. Metal-coated polyester fibers are especially useful for this purpose.

Another important variable available to the designer is control over strand length and color, these factors being of primary importance in minimizing the risk of visual detection of the camouflaged target. As shown in FIG. 1, looped strands 15 are short, looped strands 16 are of intermediate length, and looped strands 17 are longest, it being understood that fewer of greater numbers of strand lengths can be used if desired. Backing layer 11 may also be dyed a specific color if this enhances the overall effect.

As an example of camouflage multicoloration patterning, the darker shadowed parts of natural terrains are simulated by coloring the short strands black, whereas the brown tones of natural terrain are simulated by dying the intermediate-length strands in one or more shades of brown or tan. The green tones of natural terrain are reproduced by making the longest strands in one or more shades of green, with the dye and delustrant being selected to provide visual and infrared reflection properties simulating the reflectance of natural leaves, foliage, and other terrain features.

The multispectral reflectance properties of the individual yarn strands are thus selected and arranged to simulate the corresponding characteristics of the simulated physical terrain feature. Green yarn patterns are given a high reflectance to simulate that property in natural grass, leaves, and the like. Black yarn patterns typically simulate shadowed environment, and have a much lower reflectance. Similarly, brown yarn patterns typically simulate branches, limbs, or soil, and are given a low reflectance.

In addition to the three-dimensional effects of a multilevel pile construction, yarns of different colors may be used at the same pile height to achieve desired surface qualities. Further, the desired dominant color in a specific pile height can be achieved by using yarn of that color in a high number or weight which suppresses yarns of different coloration at the same pile height.

The closed-loop tufted construction of pile body 13 provides great flexibility to the designer in simulating a variety of terrain backgrounds, and in creating a three-dimensional effect which enables target concealment with respect to both near and distant viewers and sensors. Modern weaving machines permit construction of tufted pile bodies of varying heights and spacing (in the machine direction), enabling endless variations in coloration and other visual effects, as well as reflection and absorption characteristics in the nonvisual wavelengths.

Typical weaving machinery can be adjusted to provide a wide range of pile tuft spacings, depending on the desired effect. Very fine simulation detail is achieved by tight arrays of yarn strands spaced apart as little as 5/64 inch. This enables placement of strands having desired properties in adjacent backing-layer areas less than 0.01 square inches, in turn permitting a display of very small elements which collectively provide the desired pattern.

Examples of several of the various effects which can be produced are shown in FIGS. 2–6 where lighter colored (e.g., green) strands are shown as open loops, intermediate-colored (e.g., brown) strands are marked with an "x," and dark (e.g., black) strands are marked with horizontal lines. FIGS. 2A and 2B show elevation and plan views of a single-height pile body, and it will be noted that the similarly colored strands are not linearly arranged (which might permit detection) but are somewhat wavy and uneven in the machine direction. This somewhat sinusoidal orientation is easily achieved by lateral oscillation in the weaving machine.

FIGS. 3A and 3B show elevation and plan views of a two-level construction with the longer and higher uncut tufts "blooming" over the lower tufts to provide the dominant surface color (brown in the illustrated example) and nonvisual effect. This lateral expansion or mushroom-like blooming of the longer high-level strands over the supportive lower-level tufts enables selective concealment of lower-level properties not needed or desired in that portion of the camouflage display. FIGS. 4A and 4B show another two-level arrangement in which a two-color visual effect is created at the surface level.

FIGS. 5A and 5B show a three-level tuft construction with a single dominant visual surface coloration, and FIGS. 6A and 6B show another three-level construction where the tuft spacing exposes some low-level tufts for a multicoloration visual effect. Covered tufts continue to provide desired absorption and scattering of nonvisual wavelengths. Variable positioning of weaving-machine tufting needles, control over yarn tension, and freedom to use different yarn weights are factors which contribute to the designer's ability to create a variety of desired effects in the camouflage design.

It is thus possible to create a close simulation of the pattern, color and texture of natural terrain by designing the individual strands to provide an integrated effect simulating a three-dimensional image which conceals the target at both near and distant observation distances. The height dimension and blooming shape of the uppermost tufts enables creation of a generalized appearance to a distant viewer, this appearance becoming more detailed as the observer's viewing distance is decreased, or when the camouflage is seen from different angles. Tiny details (flower, twigs, leaves, grass, etc.) in nature-simulating combinations become visible to the close observer, and infrared reflectance provides a similarly detailed simulation of the natural environment.

The camouflage mat is normally tailored not only to the surrounding terrain, but also to the shape of the target being concealed. For example, horizontal surfaces of the mat may have one configuration of strand patterns and colors, whereas a different configuration is used in sloping or vertical portions of the mat to flatten the image perceived by a viewer.

These varying patterns can be continuously woven, or separately woven as panels which are then assembled to form the overall camouflage mat which mates with the surrounding natural environment to provide an exact illusion of different levels of vegetation or other natural features with a multispectral signature exactly matching that of the environment. The use of automated computer-controlled weaving machines (already in use in the carpet industry) enables these capabilities to be quickly and economically implemented by the designer.

Another set of variables available to the designer is the addition of particulate, fibrous, or sheet materials to backing layer 11. This capability is particularly important in preventing passive-infrared-sensor target detection by reflecting and preventing transmission of infrared energy emanating from the target. This function is achieved by securing (by gluing or other conventional laminating methods) one or more layers or sheets of infrared-blocking material to the backing layer.

Polyurethane plastic is usually a good choice for sheet 20, but metal foils (or a laminate of metal foil and polyurethane) may be used. Fiberglass is another acceptable infrared-blocking material, either in sheet form, or in strands woven into or adhered to the undersurface (which faces the object to be concealed) of the backing layer. The impervious nature of the backing layer and associated laminae prevents leakage of heat energy which may be radiated from the target being concealed by the camouflage system.

Control of incoming microwave energy is another function which is managed at the backing-layer level in addition to the use of reflecting and absorbing materials in the yarn strands as already described. For example, absorption of microwave energy is achieved by adhering or integrating into sheet 20 a body of carbon or graphite fibers dimensioned to be of maximum effectiveness at the radar wavelengths which are anticipated. Similarly, metallic strands (dimensioned in accordance with the design parameters of well-known chaff decoys) are used if reflection is the desired property.

A further refinement using sandwiched polypropylene layer 11 and polyurethane sheet 20 is to provide metal-foil or glass-fiber sheets 21 within the laminate, which may also include a dispersion of fibers or strands as mentioned above for reflection, scattering, or absorption of radar energy. The laminated construction is strong and resistant to traffic (the more fragile metal foil or glass-fiber sheet being protected by the adjacent rugged plastic sheet), and is impermeable to liquids and target-emitted infrared energy.

In some camouflage applications it may be desirable to include a water-vapor or liquid-water signature to the mat surface. This can be done by providing some of the tufted yarn strands with a water-absorbing property, but is usually more easily and effectively handled by stitching wool yarn or thread into the base layer of the mat. The wool material absorbs rainwater or other applied moisture, and the presence of this water, coupled with normal atmospheric evaporation, gives the desired signature.

The invention thus gives the designer freedom to choose a wide variety of broadband reflecting, scattering, and absorption properties in a rugged integrated matting which is equally useful in camouflage and target-simulating (decoy) applications against any kind of background natural terrain. These goals are achieved by integration of many of the needed properties into the individual fibers constituting the yarn strands of the mat pile, and by supplementing these characteristics with further properties of fibers or sheets secured to the pile-supporting backing layer. The result is an ability to create customized camouflage mats which are mechanically strong, resistant to environmental attack, and well suited to a broad range of target concealing or simulating applications where effectiveness through the entire ultraviolet-microwave range is needed.

Of particular importance is the multilevel tuft construction which provides a three-dimensional effect, and accurate terrain simulation over a range of potential viewing angles. The designer controls the size, orientation, and properties of individual tufts, and can thereby simulate very fine detail if close-range observation is expected. Just as in the natural environment, these fine details blend and merge as observation range is increased, with twigs and leaves first merging into a branch, for example, and branches then merging into a tree or other larger terrain feature.

Just as these visual features are made as closely similar to the natural terrain as the designer desires, the signature of the camouflage mat to nonvisual wavelengths can also be tailored as closely as is desired to the terrain, or to a simulated target in the decoy application. Radar signals can be reflected, absorbed, or scattered at one or several levels in the mat construction. Similarly, control is available over ultraviolet and infrared (whether interrogating or target-emitted) energy by properties integrated into the yarn-strand fibers, as well as by sheets or particulates at the level of the backing layer and auxiliary substrates.

FIG. 7 shows another embodiment of the invention in the form of a light-penetrable netlike screen 30. The screen is unlike mat 10 in that a tufted construction is not used, but shares with mat 10 the concept of plastic components integrally embodying various additives which impart selected and desired camouflage properties, weather and fire resistance, and other previously described characteristics. Apart from the integration of these properties into the plastic components, the general structure of screen 30 is in the prior art, and these known attributes will be first described, and followed by a disclosure of the inventive features.

Screen 30 in typical form is a relatively large panel (perhaps 20 to 30 feet on a side, and square, rectangular, or some other geometric shape in plan view) which is bounded by a strong rope or cord 31 extending around the panel perimeter. Cord 31 may carry spaced-apart clips (not shown) for attachment to mating clips on adjacent panels where multiple panels are joined to cover a large area.

A mesh of screening material or garnish 33 is supported by and extends across the perimeter defined by cord 31, and is secured to the cord at spaced-apart locations 34 by cemented or sewn attachment or any convenient connection means. Garnish 33 is originally formed as a flat sheet of polyester plastic material, and is painted on both sides (different colors may be used on the opposed surfaces), and then severed by a slitting operation which forms a series of phase-aligned, discontinuous, and generally parallel and, sinusoidal cuts through and across the length and breadth of the painted panel.

The slit panel is then tensioned to cause the slit portions to separate and deflect out of the plane of the original flat sheet into a three-dimensional meshwork of curved and partially separated elements 35 as shown in FIG. 7.

This style of construction is suggested in prior-art disclosures (e.g., U.S. Pat. No. 3,069,796), and the camouflage properties are imparted by separately applied coatings or particulates added to the basic panel sheet material prior to slitting.

In contrast, the embodiment of my invention exemplified by screen 30 uses garnish 33 which is formed from plastic sheet material into which camouflage properties operative and effective in nonvisual wavelengths are integrally incorporated in the plastic material prior to extrusion into a sheet form. Any or all of the camouflage properties already described in connection with mat 10 can be mixed into the liquid polymer or prepolymer material prior to extrusion into the panel or sheet which is then cut and tensioned to form garnish 33 and elements 35.

The basic garnish sheet may also be formed as a multi-ply panel of cross-laminated sheets which add strength to the overall camouflage system, and enable integrated incorporation of different properties in the several plies (just as additives can be allocated to different fibers of mat 10 as discussed above) to provide a desired overall spectral response. Color can be one of the integrated properties, and the multi-ply construction enables production of garnish having different colors on the opposed faces.

If desired, a supporting net of slender threadlike strands 37 may also be sewn to cord 31 to extend across the screen and support the garnish matrix. Preferably, polypropylene plastic is used for all the components of screen 30, because it has the ability to incorporate relatively large amounts of camouflage additives, and is strong, weather resistant, and capable of extrusion into sheet form.

Whether used in the style of mat 10 (which completely covers an object to be concealed) or screen 30 (which admits daylight and permits visual observation therethrough from beneath the screen), the described embodiments of the invention share the concept of integral incorporation of camouflage properties in the base material forming the protective camouflage. This novel construction provides freedom to the designer to provide camouflage appropriate to a particular application in a controlled and economical fashion, and with effectiveness and ruggedness needed in difficult military applications.

What is claimed is:

1. A light-penetrable camouflage system for positioning over an object to be concealed from remote detection, comprising an apertured sheet of garnish material made of plastic, the plastic integrally embodying additives providing selected camouflage properties with respect to nonvisual wavelengths.

2. The system defined in claim 1 wherein the plastic is polypropylene.

3. The system defined in claim 2 wherein the additives impart camouflage properties with respect to radar energy.

4. The system defined in claim 2 wherein the additives impart infrared energy.

5. The system defined in claim 2 wherein the additives impart ultraviolet energy.

6. A light-penetrable camouflage system for positioning over an object to be concealed from remote detection, comprising an apertured multi-ply laminated sheet of garnish material made of plastic, at least one of the plastic plies integrally embodying additives providing selected camouflage properties with respect to nonvisual wavelengths.

7. The camouflage system of claim 6 wherein each ply of the laminated sheet is polypropylene plastic.

8. The camouflage system of claim 7 wherein the several plies of the laminated sheet are cross laminated.

9. The camouflage system of claim 7 wherein each ply of the laminated sheet integrally incorporates additives providing selected camouflage properties with respect to nonvisual wavelengths.

10. The camouflage system of claim 9 and further comprising a supporting cord secured to and extending around the perimeter of the garnish material.

11. The camouflage system of claim 10 and further comprising a net suspended from the cord and supportively underlying the garnish material.

12. The camouflage system of claim 11 wherein the cord and net are made of polypropylene plastic.

* * * * *